US005390920A

United States Patent [19]

Nickum

[11] Patent Number: 5,390,920

[45] Date of Patent: Feb. 21, 1995

[54] ADJUSTABLE HEAD GOLF CLUB WITH POSITIVE LOCKING MECHANISM AND LOCKING SCREW THEREFORE

[76] Inventor: Robert H. Nickum, c/o Norwood Tool & Die Co., 5123 Montgomery Rd., Cincinnati, Ohio 45212

[21] Appl. No.: 186,841

[22] Filed: Jan. 26, 1994

[51] Int. Cl.[6] ..... A63B 53/02

[52] U.S. Cl. ..... 273/80.1; 273/80 C; 273/167 G

[58] Field of Search ..... 273/80.1, 80.2, 193 R, 273/194 R, 77 R, 167 R, 79, 168, 167 G, 80 C, 80 R; 411/39, 512, 910, 911

[56] References Cited

U.S. PATENT DOCUMENTS

| | | | |
|---|---|---|---|
| 749,174 | 1/1904 | Davis | 273/79 |
| 2,708,579 | 5/1955 | Hugman | 273/80.1 |
| 3,096,982 | 7/1963 | Bassin | 273/80.1 |
| 3,214,170 | 10/1965 | Warnock | 273/80.1 |
| 4,067,572 | 1/1978 | Coleman | 273/79 |
| 4,073,492 | 2/1978 | Taylor | 273/80.2 |
| 4,881,737 | 11/1989 | Mullins | 273/80.1 |

*Primary Examiner*—Sebastiano Passaniti
*Attorney, Agent, or Firm*—Frost & Jacobs

[57] ABSTRACT

A golf club having an adjustable head with a positive locking mechanism. The lower end of the golf club shaft terminates in a spherical ball which is restrained within a cooperating bore in the golf club head which permits free rotational and pivotal movement of the head with respect to the shaft. A locking screw, when tightened within the bore, holds the pivot ball in place against rotational and pivotal motion. A portion of the locking screw is designed to break off after tightening so that the position of the head cannot be changed during play.

9 Claims, 3 Drawing Sheets

ADJUSTABLE HEAD GOLF CLUB WITH POSITIVE LOCKING MECHANISM AND LOCKING SCREW THEREFORE

A. BACKGROUND OF THE INVENTION

1. Field of the Invention

This invention relates to golf clubs, and more particularly to a golf club in which the head can be adjusted to a multiplicity of positions and thereafter positively locked in a desired position. The golf club is provided with a novel locking screw which is designed to break off after the golf club head has been locked in the desired position to prevent further adjustment of the head. The present invention finds particular application to golf clubs of the putter type.

2. Description of Related Art

Various types of golf clubs have been described with golf club heads which can be adjusted to one of a number of desired positions. However, none of these prior designs is believed to be satisfactory because even when adjusted to the desired position, there remains the possibility that the golf club head can be further adjusted, either deliberately or accidentally. The possibility that the head may be adjusted during play is a particular problem, since a freely adjustable head golf club may be counted as one or more golf clubs during play, or may be prohibited altogether.

Consequently, a need exists not only for a golf club having an adjustable head which can be securely and reliably locked in any desired position, but one whose position of the head, once made, cannot be changed during play.

B. SUMMARY OF THE INVENTION

In a preferred embodiment of the present invention, the lower end of a conventional golf club shaft is provided with a generally spherical pivot ball having an exterior bearing surface. The associated golf club head includes a centrally located bore extending from the upper surface of the head to the lower surface of the head. The pivot ball is rotatably and pivotally captured within the bore. The upper end of the bore is provided with an inwardly directed annular shoulder having a central opening smaller than the diameter of the ball for preventing disengagement of the pivot ball from the bore.

A locking screw threadedly engages the lower end of the bore so that in a loosened position the golf club head may freely pivot and rotate about the pivot ball. However, when the pivot screw is tightened, such that the upper surface of the locking screw forcibly abuts the lower end of the pivot ball, the upper end of the pivot ball is forced against the annular shoulder so as to securely and positively lock the golf club head in place.

To prevent unauthorized tampering of the golf club adjustment during play, the locking screw is provided with a lower portion which is configured to engage a tightening tool and an upper portion having an upper surface for engaging the lower end of the pivot ball. The upper and lower portions of the locking screw are connected by a portion of smaller diameter which is designed to break off when the tightening force exerted on the lower locking screw portion exceeds a predetermined value. When this occurs, the locking screw cannot be further tightened or loosened, thereby preventing unauthorized adjustment.

Further features of the invention will become apparent from the detailed description which follows.

C. BRIEF DESCRIPTION OF THE DRAWING

While the specification concludes with claims particularly pointing out and distinctly claiming the present invention, it is believed the same will be better understood from the following description taken in conjunction with the accompanying drawing in which:

Figure 8A:
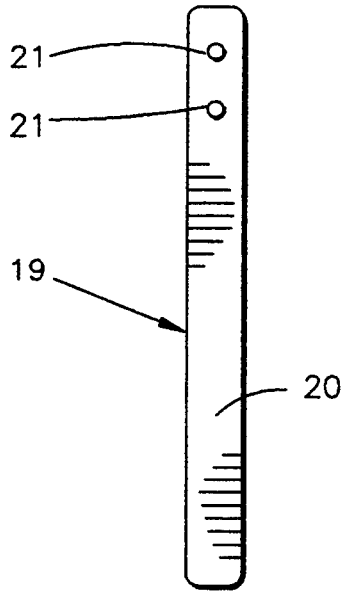

FIG. 8*a* is a top plan view of an adjustment tool usable with the present invention.

Figure 8B:
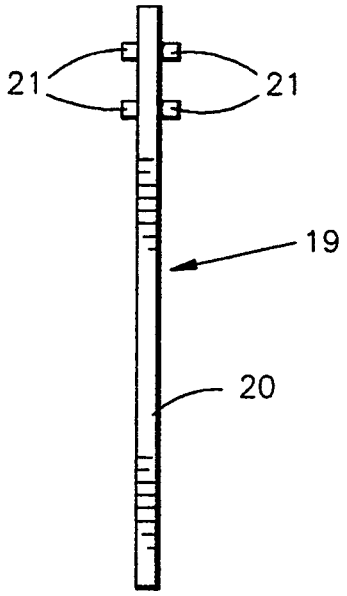

FIG. 8*b* is a side elevational view of an adjustment tool usable with the present invention.

Figure 9:
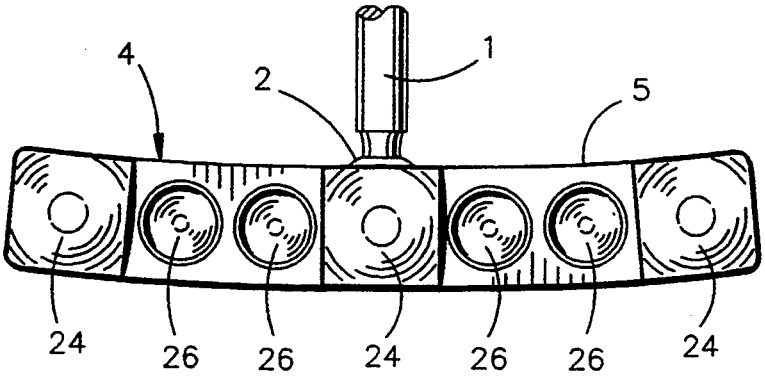

FIG. 9 is a fragmentary front elevational view of a second embodiment of the adjustable head golf club of the present invention.

Figure 10:
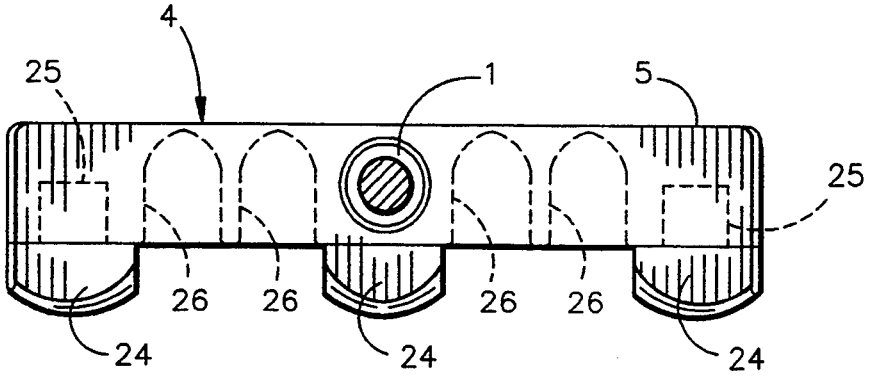

FIG. 10 is a partially cross-sectional top plan view of a second embodiment of the adjustable head golf club of the present invention.

D. DESCRIPTION OF THE PREFERRED EMBODIMENT

Figure 1:
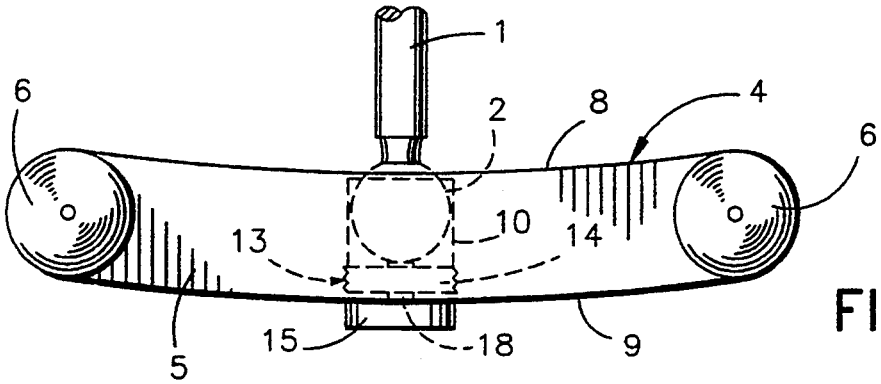
FIG. 1 is a fragmentary front elevational view of a first embodiment of the adjustable golf club head of the present invention.
Figure 2:
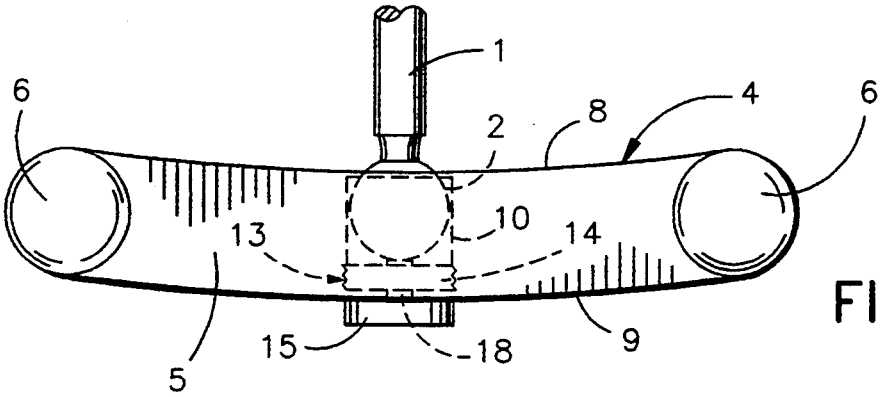
FIG. 2 is a rear elevational view of a first embodiment of the adjustable golf club head of the present invention.
Figure 3:
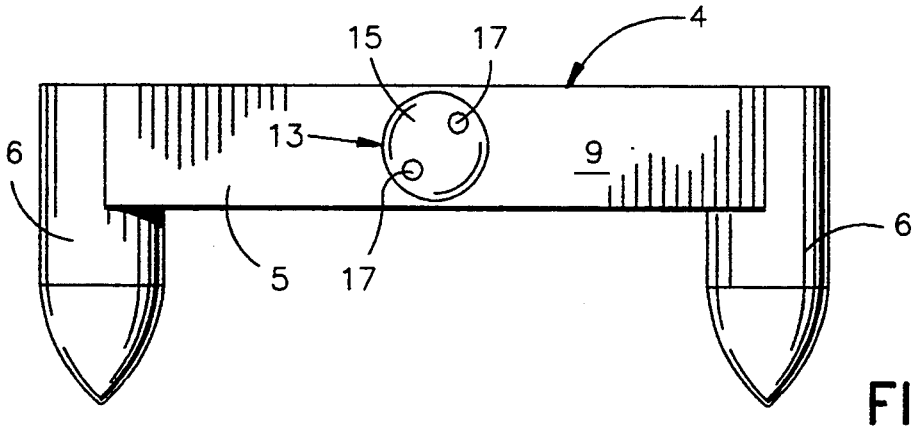
FIG. 3 is a bottom plan view of a first embodiment of the adjustable golf club head of the present invention.
Figure 4:
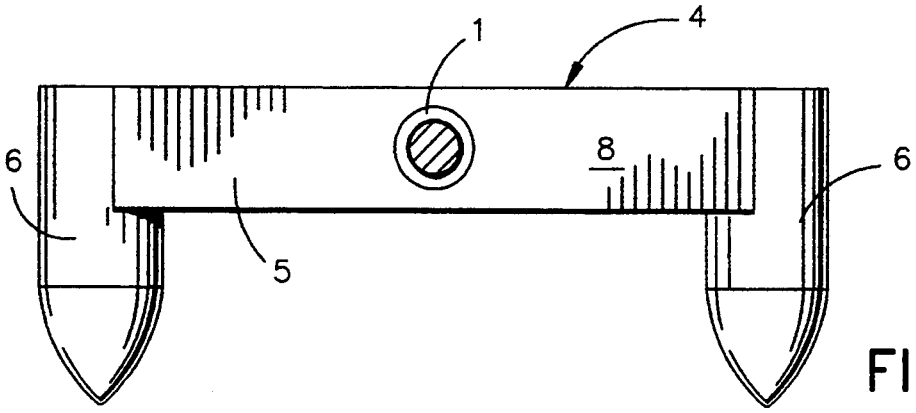
FIG. 4 is a partially cross-sectional view of a first embodiment of the golf club head of the present invention.

FIG. 1 and FIG. 2 depict the lower end of a golf club incorporating the adjustable head of the present invention. The golf club includes a tubular hollow golf club shaft shown generally at 1 of conventional construction. It will be understood that the upper portion of the golf club, including the grip, is also of conventional construction.

The lowermost end of shaft 1 terminates in a generally spherical pivot ball 2. Pivot ball 2 incorporates an exterior bearing surface 3. (See, FIG. 5 and FIG. 6.)

The lower portion of the golf club includes a golf club head, shown generally at 4. While for purposes of an exemplary showing a putter has been illustrated, it will be understood that the inventive concepts described herein may be employed with other types of golf clubs as well. Further, it will be understood that golf club head constructions other than those specifically described and illustrated herein may be employed in conjunction with the present invention.

Head 4 comprises a generally rectangular block 5 of somewhat arcuate construction. A bullet-shaped weight 6 is attached to each end of block 5 so as to provide stability to the golf club head as well as increase the size of the "sweet spot", as is well understood in the art.

The central portion of block 5 of head 4 is provided with a vertical interior bore 7 which extends from the upper surface 8 of head 4 to the lower surface 9. At least the lower portion of bore 7 is provided with an interior thread as at 10.

Figure 5:
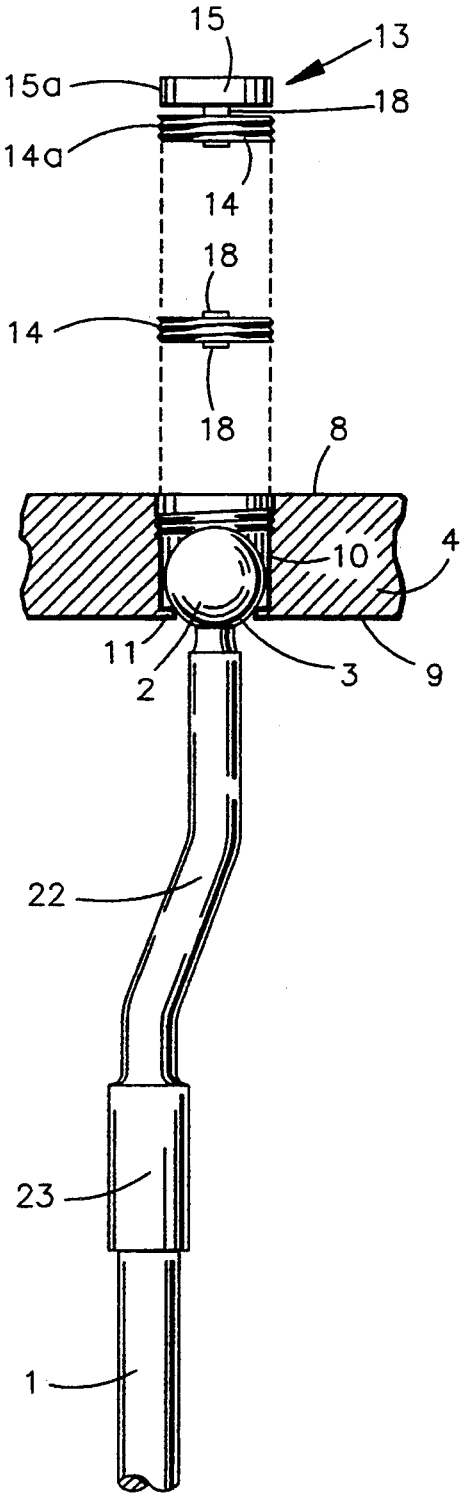
FIG. 5 is a fragmentary partially cross-sectioned exploded view showing a portion of the adjustable golf club head of the present invention illustrating the operation of the locking screw.
Figure 6:
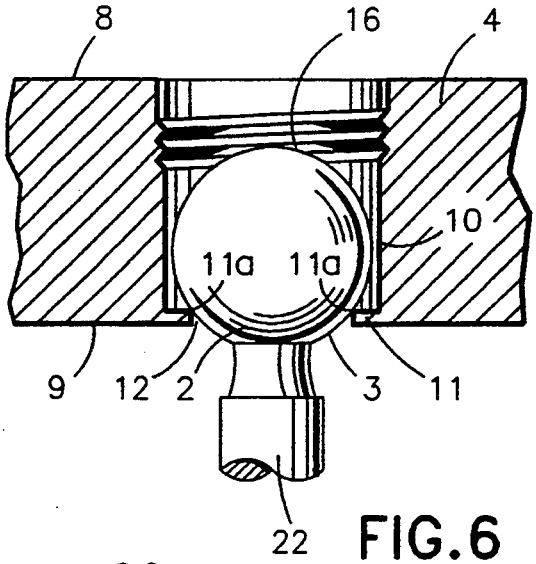
FIG. 6 is an enlarged fragmentary partially cross-sectioned view illustrating the construction of the adjustment mechanism of the present invention with the upper portion of the locking screw in the tightened position.
Figure 7:
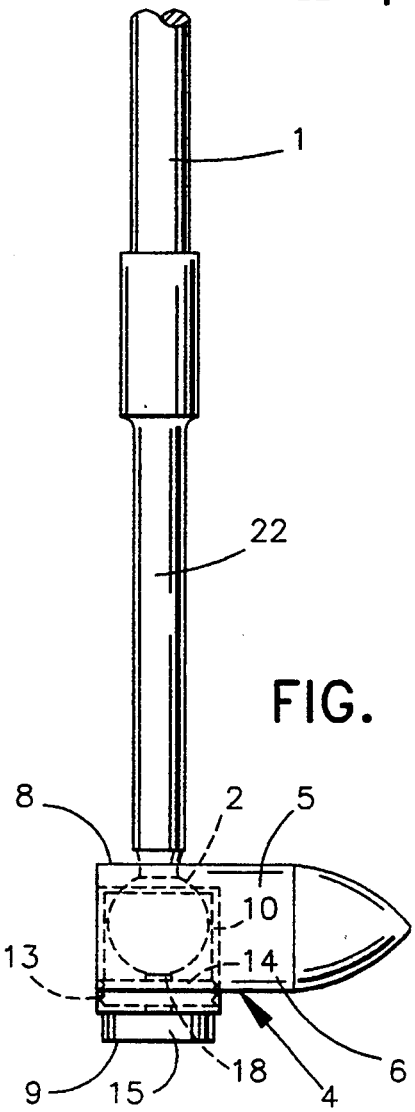
FIG. 7 is a fragmentary side elevational view of a first embodiment of the adjustable head golf club of the present invention.

As can best be seen in FIG. 5 and FIG. 6, the upper end of bore 7 is provided with an annular shoulder 11 which extends inwardly toward the center of the bore 7. Annular shoulder 11 contains a central opening 12 smaller than the diameter of pivot ball 2 for preventing disengagement from the ball from the bore, as will be described in more detail hereinafter.

As can best be seen in FIG. 5 and FIG. 6, the lower end of shaft 1 is positioned so that pivot ball 2 is captured within bore 7 with the uppermost bearing surface 3 of the pivot ball extending slightly above the upper surface of annular shoulder 11. The diameter of pivot ball 2, as well as the interior diameter of bore 7, will be dimensioned to permit free rotation and pivotal motion of the ball within the bore.

The adjustable golf club head of the present invention is also provided with a locking screw for positively locking the adjustable head in a desired position. In the preferred embodiment illustrated, the locking screw, shown generally at 13, comprises a generally cylindrical upper portion 14, a threaded outer edge 14*a*, and a generally cylindrical lower portion 15 similarly having a threaded outer edge 15*a*. Both upper portion 14 and lower portion 15 are dimensioned so as to threadedly engage within the cooperating threaded portions of bore 7.

The upper surface of upper locking screw portion 14 is provided with a centrally located dish-shaped depression 16 configured to generally match the outer curvature of pivot ball 2. If desired, depression 16 may be omitted. The lower surface of lower locking screw portion 15 is provided with two spaced inwardly extending bores 17, which serve to permit engagement by a locking tool as will be described hereinafter.

Upper locking screw portion 14 and lower locking screw portion 15 are connected by a short generally cylindrical connecting portion 18 of smaller outer diameter than the upper and lower locking screw portions. As will be described hereinafter, central portion 18 is frangible so as to break off when sufficient force is exerted on lower locking screw portion 15.

In operation, locking screw 13 is loosely threaded within threaded bore 7 so that the upper surface of locking screw portion 14 does not abut the lower surface of pivot ball 2. This permits the pivot ball, and hence the golf club head 4, to be freely rotated and pivoted with respect to shaft 1. Consequently, the head can be pivoted or rotated to any desired position to attain a specific lie (parallel to the head) and positive or negative loft (perpendicular to the head). Also, it will be observed that by merely rotating the head, a left handed or right handed golf club may be obtained.

When the desired position of the golf club head with respect to the shaft is obtained, the locking screw is tightened in place. This may be accomplished by the exemplary locking tool 19 illustrated in FIG. 8*a* and FIG. 8*b*. Locking tool 19 comprises an elongated handle portion 20 with two spaced pins 21 extending from one or both sides of the handle. Pins 21 are dimensioned and configured to mate with and engage bores 17 in the locking screw lower portion 15 in order to threadedly tighten locking screw 13 within threaded bore 7.

In the preferred embodiment illustrated, locking screw 13 is tightened by means of tool 19 until a predetermined force level is reached, whereupon frangible central portion 18 breaks off, thereby separating lower locking screw portion 15 from upper locking screw portion 14. This operation results in the upper surface of upper locking screw 14 being forcibly engaged against the lower surface of pivot ball 2. This serves to force pivot ball 2 upwardly so that the upper portion of bearing surface 3 comes into tight abutting contact with annular shoulder 11. It will be observed, however, that it is preferred the lower lock screw portion does not enter the threaded bore. In order to increase the frictional engagement between bearing surface 3 and annular shoulder 11 to insure that pivot ball 2 remains locked in place, the lowermost inner edge 11 a of annular shoulder 11 may be sharpened to provide a biting engagement with the outer surface of pivot ball 2. Once the head has been locked in place as described, the lower locking screw portion 15 may be removed entirely, leaving upper portion tightened in place in the configuration illustrated in FIG. 6.

This operation is illustrated in the exploded portion of FIG. 5. In the upper part of that figure, locking screw 13 is shown prior to being threadedly engaged within bore 7. After locking screw 7 has been tightened in place and central portion 18 breaks off, the upper portion 14 of the locking screw remains in place with a small part of central portion 18 still attached. The lower portion 15 of the locking screw (also with a small part of central portion 18 attached) may then be removed from the threaded bore, as illustrated in the upper central portion of FIG. 5.

Thus, this operation provides positive locking of the head to the shaft. At the same tithe, it will be observed that upper portion 14 cannot be readily removed from within the threaded bore 7 without special equipment. Thus, the orientation of the head with respect to the shaft cannot be changed during play.

The lower portion of shaft 1 adjacent pivot ball 2 may be straight, or as illustrated in FIG. 5 may be provided with an offset portion immediately below hostel 23. This provides better visibility of the ball, as is well understood in the art.

An alternate embodiment for the configuration of golf club head 4 is illustrated in FIG. 9 and FIG. 10 where elements previously described have been similar designated. This embodiment utilizes three spaced weights 24 which are press-fitted into the rear surface of the golf club head. Again, the purpose of these weights is to improve the balance of the golf club head, as well as to provide a larger "sweet spot." To further reduce weight, block 5 is provided with four inwardly extending bores 26. However, it will be understood that any number of weights or bores may be utilized, or they may be eliminated altogether. In all other respects, the positive adjustment mechanism of the present invention will be the same as previously described.

It will be understood that modifications may be made in the invention without departing from the spirit of it.

I claim:

1. A golf club comprising:

a shaft having a lowermost end, the lowermost end of said shaft terminating in a generally spherical pivot ball having an exterior bearing surface including a lower bearing surface and an upper bearing surface;

a golf club head having an upper surface and a lower surface and including a bore extending from said upper surface to said lower surface of said head, said bore having an upper end and a lower end, said ball being rotatably and pivotally captured within said bore, said upper end of said bore being provided with an inwardly directed annular shoulder having a central opening smaller than the diameter of the ball for preventing disengagement of said ball from said bore and a pivot ball contacting portion; and a locking screw having an upper end and a lower end threadedly engaging a portion at least of said lower end of said bore, said locking screw when in a loosened position permitting free rotation and pivotal motion of said ball within said bore so that said golf club head can be adjusted to a desired position, said upper end of said locking screw when in a tightened position contacting a portion at least of said lower bearing surface of said ball so as to force a portion at least of said upper bearing surface of said ball into engagement with said shoulder to prevent rotation and pivotal motion of said ball, thereby positively locking the golf club head in the desired position with respect to said shaft;

said locking screw including a lower portion configured to be engaged by a tightening tool, said locking screw further including an upper portion having an upper surface configured to forcibly engage said lower bearing surface of the pivot ball, and a frangible portion connecting said upper and lower locking screw portions, said frangible portion being configured to cause separation of the upper and lower locking screw portions when the engagement force applied to the pivot ball by the upper locking screw portion exceeds a predetermined amount sufficient to positively lock the golf club head in the desired position with respect to the shaft.

2. The golf club according to claim 1 wherein said bore is centrally located on said golf club head.

3. The golf club according to claim 1 wherein said shaft is provided with an angularly disposed offset adjacent said golf club head.

4. The golf club according to claim 1 wherein said pivot ball contacting portion of said shoulder is provided with a sharpened edge for engaging the bearing surface of the ball when the locking screw is in the tightened position.

5. The golf club according to claim 1 wherein said lower locking screw portion does not enter said threaded bore.

6. The golf club according to claim 1 wherein said upper locking screw portion is configured to resist removal after said frangible portion operates to separate said upper and lower locking screw portions.

7. A locking screw in combination with an adjustable head golf club of the type having a shaft including a lowermost end, said lowermost end of said shaft terminating in a generally spherical pivot ball having an exterior bearing surface including an upper bearing surface and a lower bearing surface, and a golf club head including an upper surface and a lower surface, said head further including a threaded bore extending from said upper surface to said lower surface of said head, said locking screw comprising:

an upper portion for threadedly engaging the golf club head bore and having an upper surface configured to abut the lower bearing surface of the pivot ball;

a lower portion having a lower surface configured to be engaged by a tightening tool; and a central portion connecting said upper and lower locking screw portions, said central portion being configured to separate said lower portion from said upper portion, when said upper portion has been tightened against said pivot ball.

8. The combination according to claim 7 wherein said central portion is configured to separate said upper and lower locking screw portions when the force supplied to said lower portion exceeds a predetermined value.

9. The combination according to claim 8 wherein said central portion is configured to break off when the force applied to said lower portion exceeds a predetermined value.

* * * * *